US007695647B2

(12) United States Patent
Smela et al.

(10) Patent No.: US 7,695,647 B2
(45) Date of Patent: Apr. 13, 2010

(54) ELECTRICALLY CONDUCTIVE METAL IMPREGNATED ELASTOMER MATERIALS AND METHODS OF FORMING ELECTRICALLY CONDUCTIVE METAL IMPREGNATED ELASTOMER MATERIALS

(75) Inventors: Elisabeth Smela, Silver Spring, MD (US); Remi Delille, Greenbelt, MD (US); Mario Urdaneta, Berwyn Heights, MD (US); Samuel Moseley, University Park, MD (US)

(73) Assignee: University of Maryland, College Park, MD (US)

( * ) Notice: Subject to any disclaimer, the term of this patent is extended or adjusted under 35 U.S.C. 154(b) by 0 days.

(21) Appl. No.: 11/946,425

(22) Filed: Nov. 28, 2007

(65) Prior Publication Data

US 2008/0277631 A1 Nov. 13, 2008

Related U.S. Application Data

(63) Continuation of application No. PCT/US2006/022672, filed on Jun. 9, 2006.

(60) Provisional application No. 60/688,844, filed on Jun. 9, 2005, provisional application No. 60/746,928, filed on May 10, 2006.

(51) Int. Cl.
*H01B 1/02* (2006.01)
*H01B 1/22* (2006.01)

(52) U.S. Cl. ..... 252/512; 252/513; 252/514; 257/417

(58) Field of Classification Search ..... 252/512, 252/513, 514; 257/417
See application file for complete search history.

(56) References Cited

U.S. PATENT DOCUMENTS

| | | | | |
|---|---|---|---|---|
| 3,501,332 | A * | 3/1970 | Buckman | 427/304 |
| 3,719,913 | A * | 3/1973 | DuBose et al. | 338/2 |
| 4,546,010 | A | 10/1985 | Killer et al. | |
| 4,666,742 | A | 5/1987 | Takakura et al. | |
| 4,959,132 | A | 9/1990 | Fedkiw, Jr. | |
| 5,135,780 | A | 8/1992 | Kissel | |
| 6,109,852 | A | 8/2000 | Shahinpoor et al. | |
| 6,316,084 | B1 | 11/2001 | Claus et al. | |
| 6,475,639 | B2 | 11/2002 | Shahinpoor et al. | |

(Continued)

OTHER PUBLICATIONS

R. Pelrine, R. Kombluh, and G. Kofod, "High-strain actuator materials based on dielectric elastomers," Adv. Mat., vol. 12, pp. 1223-1225, 2000.

(Continued)

*Primary Examiner*—Mark Kopec
*Assistant Examiner*—Jaison P Thomas
(74) *Attorney, Agent, or Firm*—Edell, Shapiro & Finnan, LLC

(57) ABSTRACT

An electrically conductive, compliant elastomer material that is impregnated with a metal is formed by combining a metal salt with an elastomer precursor material to form a metal salt/precursor mixture, curing the metal salt/precursor mixture to form an elastomer impregnated with metal salt, and treating the elastomer impregnated with metal salt with a chemical reducing composition so as to convert at least a portion of the metal salt impregnated within the elastomer to a metal. The elastomer can be subjected to a suitable solvent that swells the elastomer during the chemical reduction of the metal salt to metal, which enhances the mechanical and electrical properties of the resultant metal impregnated elastomer material.

15 Claims, 10 Drawing Sheets

U.S. PATENT DOCUMENTS

| | | | | |
|---|---|---|---|---|
| 6,876,125 | B2 | 4/2005 | Basheer et al. | |
| 6,940,211 | B2 | 9/2005 | Pelrine et al. | |
| 2003/0080442 | A1 * | 5/2003 | Unger | 257/787 |

OTHER PUBLICATIONS

R. Pelrine, R. Kombluh, Q. B. Pei, and J. Joseph, "High-speed electrically actuated elastomers with strain greater than 100%," Science, vol. 287, pp. 836-839, 2000.

R. Pelrine, R. Kombluh, J. Joseph, R. Heydt, Q. B. Pei, and S. Chiba, "High-field deformation of elastomeric dielectrics for actuators," Mat. Sci. Eng. C, vol. 11, pp. 89-100, 2000.

L. Bay, K. West, P. Sommer-Larsen, S. Skaarup, and M. Benslimane, "A conducting polymer artificial muscle with 12% linear strain," Adv. Mat., vol. 15, pp. 310-313, 2003.

J. Jones, S. P. Lacour, S. Wagner, and Z. G. Suo, "Stretchable wavy metal interconnects," J. Vac. Sci. Technol. A, vol. 22, pp. 1723-1725, 2004.

D. S. Gray, J. Tien, and C. S. Chen, "High-conductivity elastomeric electronics," Adv. Mat., vol. 16, pp. 393-+, 2004.

T. Li, Z. Y. Huang, Z. Suo, S. P. Lacour, and S. Wagner, "Stretchability of thin metal films on elastomer substrates," Appl. Phys. Lett., vol. 85, pp. 3435-3437, 2004.

S. P. Lacour, J. Jones, Z. Suo, and S. Wagner, "Design and performance of thin metal film interconnects for skin-like electronic circuits," IEEE Electr Device L, vol. 25, pp. 179-181, 2004.

S. P. Lacour, S. Wagner, Z. Y. Huang, and Z. Suo, "Stretchable gold conductors on elastomeric substrates," Appl. Phys. Lett., vol. 82, pp. 2404-2406, 2003.

S. P. Lacour, C. Tsay, and S. Wagner, "An elastically stretchable TFT circuit," IEEE Electr Device L, vol. 25, pp. 792-794, 2004.

K. Yamaguchi, J. J. C. Busfield, and A. G. Thomas, "Electrical and mechanical behavior of filled elastomers. I. The effect of strain," vol. 2005: Wiley InterScience, 2003.

J. J. C. Busfield, A. G. Thomas, and K. Yamaguchi, "Electrical and mechanical behavior of filled elastomers 2: the effect of swelling and temperature," vol. 2005: Wiley InterScience, 2003.

K. P. Sau, T. K. Chaki, and D. Khastgir, "Carbon fibre filled conductive composites based on nitrile rubber (NBR), ethylene propylene diene rubber (EPDM) and their blend," Polymer, vol. 39, pp. 6461-6471, 1998.

M. Watanabe, H. Shirai, and T. Hirai, "Wrinkled polypyrrole electrode for electroactive polymer actuators," J. Appl. Phys., vol. 92, pp. 4631-4637, 2002.

P. Millet, F. Andolfatto, and R. Durand, "Preparation of solid polymer electrolyte composites—investigation of the ion-exchange process," J. Appl. Electrochem., vol. 25, pp. 227-232, 1995.

P. Millet, F. Andolfatto, and R. Durand, "Preparation of solid polymer electrolyte composites—investigation of the precipitation process," J. Appl. Electrochem., vol. 25, pp. 233-239, 1995.

M. Shahinpoor and K. J. Kim, "Ionic polymer-metal composites: I. Fundamentals," Smart Mater. Struct., vol. 10, pp. 819-833, 2001.

T. Li, Z. Y. Huang, Z. C. Xi, S. P. Lacour, S. Wagner, and Z. Suo, "Delocalizing strain in a thin metal film on a polymer substrate," Mech. Mater., vol. 37, pp. 261-273, 2005.

T. Li, Z. Suo, S. P. Lacour, and S. Wagner, "Compliant thin film patterns of stiff materials as platforms for stretchable electronics," J. Mater. Res., vol. 20, pp. 3274-3277, 2005.

D.-H. Khang, H. Jiang, Y. Huang, and J. A. Rogers, "A stretchable form of single-crystal silicon for high-performance electronics on rubber substrates," Science, vol. 311, pp. 208-212, 2006.

R. Delille, M. Urdaneta, S. Moseley, and E. Smela, "Benchtop Polymer MEMS," J. Microelectromech. S., vol. in press, 2006.

Stephanie P. Lacour, et al., "Stretchable Interconnects for Elastic Electronic Surfaces", Proceedings of the IEEE, vol. 93, No. 8, Aug. 2005, pp. 1459-1467.

Mario G. Urdaneta, et al., "Stretchable Electrodes with High Conductivity and Photo-Patternability", Adv. Mater. 2007, pp. 2629-2633.

Remi Delille, et al., "Compliant Electrodes Based on Platinum Salt Reduction in a Urethane Matrix", Smart Materials and Structures 16 (2007), pp. S272-S279.

* cited by examiner

ELECTRICALLY CONDUCTIVE METAL IMPREGNATED ELASTOMER MATERIALS AND METHODS OF FORMING ELECTRICALLY CONDUCTIVE METAL IMPREGNATED ELASTOMER MATERIALS

CROSS REFERENCE TO RELATED APPLICATIONS

This application is a continuation of PCT Application PCT/US2006/022672, filed Jun. 9, 2006, entitled "Electrically Conductive Metal Impregnated Elastomer Materials and Methods of Forming Electrically Conductive Metal Impregnated Elastomer Materials", which claims priority from U.S. Provisional Patent Application Ser. No. 60/688,844, entitled "Metal Impregnated Elastomers as Compliant Electrodes," filed Jun. 9, 2005, and also claims priority from U.S. Provisional Patent Application Ser. No. 60/746,928, filed May 10, 2006, entitled "Method for Manufacturing Metal Impregnated Elastomers as Compliant Electrodes,". The disclosures of these provisional patent applications are incorporated herein by reference in their entireties.

GOVERNMENT INTERESTS

This invention was made with Government support under Government Contract No. NSF ECS0238861, awarded by National Science Foundation, and Government Contract No. ARL W91 1NF0410176, awarded by Army Research Laboratory, and the Government has certain rights in the invention.

FIELD OF THE INVENTION

The present invention relates to electrically conductive elastomers that are impregnated with metal. Such elastomers are useful, for example, in forming compliant electrodes as well as other flexible electronic devices.

BACKGROUND

Flexible and compliant electrodes have been in development for some time. This is due at least in part to the increasing interest in products (e.g., flexible electronic components and "smart" clothing) which require compliant electrodes for providing interconnections between chips and other components.

One area in which compliant electrodes is desirable is in the manufacture of electroactive polymer (EAP) materials for use as "artificial muscles". EAP materials undergo a strain upon application of a voltage or current, and thus they can be used as actuators. One example of EAP materials is a dielectric elastomer actuator (DEA), which can expand in area up to 300% from a relaxed state when a voltage is applied to compliant electrodes on each face of an elastomer film. Dielectric elastomer actuators are parallel plate capacitors with an elastomeric dielectric between two compliant electrodes. When a large voltage is applied across the electrodes, the two plates are attracted to each other, applying a stress to the elastomeric dielectric between them that is transmitted laterally through Poisson's ratio. These actuators can only function properly when the electrodes are at least as compliant as the elastomeric dielectric.

There are a number of approaches known in the art for making flexible and/or compliant electrodes. One approach is to use carbon grease, which consists essentially of a grease containing carbon particles. The grease material is applied onto both surfaces of an elastomeric material. However, the disadvantage with using grease is that it is not a solid material block or film and, therefore, cannot be used in microfabricated structures or in the construction of shaped materials. In addition, the grease can be easily rubbed from the surface to which it is applied.

Another approach is to produce flexible electrodes consisting of thin layers of metal deposited on the surface of a polymer. Thin film metal electrodes can maintain their conductivity up to tens of percent strain. However, metal films can easily delaminate, particularly at defects, and expensive equipment is typically required to deposit the films.

The strain achieved with thin film metal electrodes can be increased by patterning the films into zig-zag or serpentine designs onto the polymer surface, where the zig-zag pattern is in the plane of the surface. The metal features twist out-of-plane when the polymer is stretched. However, the patterning of metal electrodes on a polymer material, typically performed using photolithography, can be difficult. Polymers can swell in, or react with, solvents and etchants, and the metal may not adhere well to the polymer. In addition, the total area of the device is limited to what can be fit into microfabrication equipment. Still another problem that is prevalent is delamination at the polymer/metal interface during stretching due to the large mismatch of mechanical moduli between the polymer and metal. Another approach to patterning the metal electrodes inplane is to use a shadow mask during metal deposition. While this process reduces complexity, shadow masks can only be used to form relatively thick lines, and the problem of lack of adhesion of the metal to the polymer is still present.

Flexible electrodes formed by metal deposition on a polymer material can also be produced with corrugation of the metal film in the z-direction. For example the polymer material can be stretched prior to depositing the metal film on the surface. Once coated, the stress on the polymer is removed, allowing it to relax to its original shape. This produces a compressive stress on the metal, which therefore wrinkles, creating a corrugated structure on the surface of the polymer. While corrugated surfaces can work well for macro-scale devices, the pre-stretching that is required to form such corrugation would be difficult to implement (and in certain applications impossible) in the formation of micro-scale devices.

Still another approach to forming flexible and/or compliant electrodes is to mix conducting particles (e.g., graphite, carbon nanotubes or silver) into a polymer matrix such as polydimethylsiloxane (PDMS) or polyurethane. A conductive path is made through the material by the particles when the particle concentration reaches the percolation threshold. Advances have been made in producing conductive polymer composites that are compatible with micromachining techniques. For example, graphite and silver particles have been mixed into polyimide and SU-8 matrices to yield conductive polymers that can be incorporated into micromachined devices. In another example, carbon nanotubes have been mixed into PDMS to form deformable capacitor electrodes. In addition, a ternary composite based on polypyrrole, PDMS, and carbon fiber has been tested as a compliant electrode material. However, the major drawback of utilizing this technique is that, as the concentration of particles increases, the elasticity of the material substantially decreases, as determined by a substantial increase in the Young's modulus of the material and/or a reduction in the ultimate strain. In addition, if a photo-patternable polymer is to be employed as the matrix, the mixture loses its ability to be patterned with light if the particles absorb or scatter light at the curing wavelength.

Inherently conductive polymers, or conjugated polymers, have also been mixed into non-conducting host polymers to form compliant electrodes. For example, elastomeric conductors have been formed by mixing polyaniline particles into gel matrices. However, this approach also results in an increase in Young's modulus. Another drawback is that polyaniline absorbs UV light, so this technique cannot be used with most photopatternable polymers.

A further approach for forming an electrically-conductive, stretchable or compliant polymer material is based upon an electrostatic assembly (ESA) technique that is described in U.S. Pat. No. 6,316,084. Using the ESA technique, hundreds of alternating layers of positively charged gold nanoclusters and negatively charged polyelectrolytes are deposited onto a substrate. This substrate can then be removed to yield a free-standing conductive rubber material. While this technique yields a compliant electrode with suitable conductivity and elasticity, it is also time consuming and very expensive.

Ionic polymer metal composites (IPMCs) can also be formed in ion-conducting polymers such as Nafion. For example, in U.S. Pat. No. 4,546,010, a technique is disclosed in which platinum salts are impregnated into an ion-exchange polymer matrix by swelling the polymer and then reducing the salts to achieve a conductive electrode of platinum metal on the ion-exchange surface. While ionic polymer-metal composite electrodes are conductive and flexible, they are not compliant, because the ion conducting material is not elastomeric. In addition, the impregnation step is difficult or impossible to perform in non-ionic polymers such as polydimethylsiloxane (PDMS).

Thus, it is desirable to manufacture a compliant electrode with a suitable conductivity and utilizing a method that is rapid while minimizing cost. It is even more desirable that such a compliant electrode be patternable.

SUMMARY

The present invention provides improved methods for forming electrically conductive compliant electrodes that are relatively easy to manufacture and thus minimize production costs. The present invention further provides novel electrically conductive metal impregnated elastomeric materials that have suitable elasticity and electrical conductivity characteristics which render such materials suitable for forming compliant electrodes as well as a variety of different flexible electronic devices.

In accordance with the present invention, a method of forming an electrically conductive, compliant elastomer material that is impregnated with a metal comprises combining a metal salt with an elastomer precursor to form a metal salt/precursor mixture, curing the metal salt/precursor mixture to form an elastomer impregnated with metal salt, and treating the elastomer impregnated with metal salt with a chemical reducing composition so as to convert at least a portion of the metal salt impregnated within the elastomer to a metal. The curing step can include at least one of exposing the metal salt/precursor mixture to electromagnetic radiation, exposing the metal salt/precursor mixture to heat, and a treating the metal salt/precursor mixture with a chemical hardening agent.

In one embodiment of the method of the invention, the chemical reducing composition comprises a solvent and a reducing agent, where the solvent swells the elastomer impregnated with metal salt to an extent that is greater than an extent to which the elastomer impregnated with metal salt swells in water. The swelling of the elastomer during reduction of the metal salt to metal enhances the electrical and mechanical properties of the metal impregnated elastomer material that is formed.

In accordance with another embodiment of the invention, an electrically conductive and compliant material comprises a base structure comprising an elastomer, and a metal mixed within the elastomer base structure. A concentration of metal at a surface of the base structure is greater than a concentration of metal at a selected depth from the surface of the base structure. The material maintains a selected range of electrical conductivity when being stretched a selected amount from a relaxed position. Preferably, the material maintains an electrical conductivity of at least about $10^{-10}$ S/cm when being subjected to a strain of at least about 1%. More preferably, the material maintains an electrical conductivity of at least about $10^{-6}$ S/cm when being subjected to a strain of at least about 5%.

In addition, a density gradient exists in the metal impregnated elastomer material, where the density of metal mixed within the elastomer base structure decreases from a surface of the base structure to a selected depth from the surface of the base structure.

The above and still further features and advantages of the present invention will become apparent upon consideration of the following detailed description of specific embodiments thereof, particularly when taken in conjunction with the accompanying drawings.

DETAILED DESCRIPTION

Figure 1:
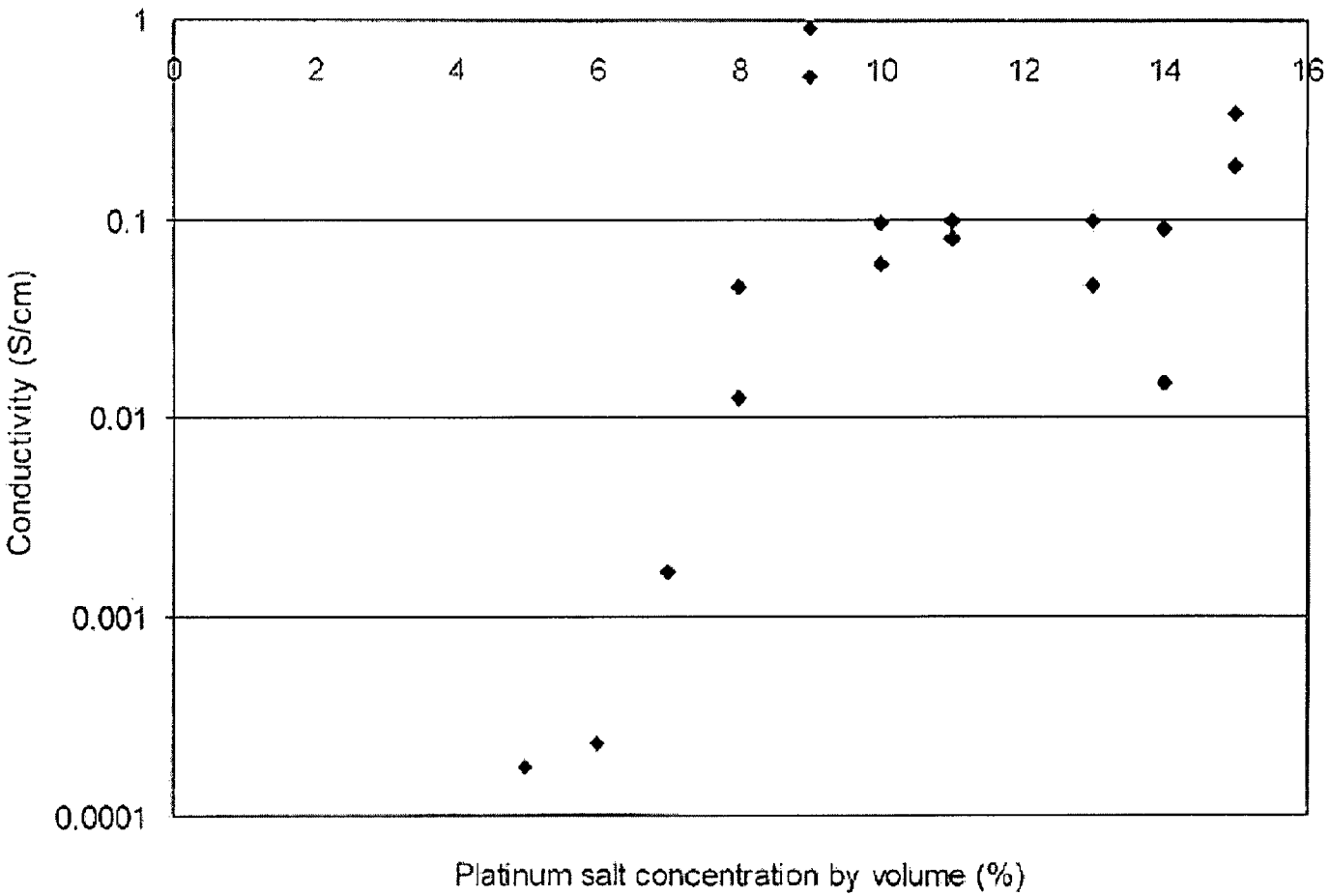
FIG. 1 is a plot of platinum salt concentration vs. electrical conductivity for platinum/LOCTITE 3108 elastomer composites formed in accordance with the invention.

Electrically conductive metal impregnated elastomeric materials and methods of forming such materials are described below in accordance with the present invention, where the elastomeric materials have sufficient conductivity as well as sufficient elasticity. Furthermore, metal-impregnated elastomeric materials and methods of forming such materials are described that can be patterned on the microscale, and in particular can be patterned with UV light. The metal impregnated elastomers can be used as compliant electrodes as well as other compliant and conductive components for use in a number of flexible electronic devices that require large deformations without damage to the components.

As used herein, the term "compliant" with reference to an electrode or material refers to a material that is both flexible and stretchable. A flexible material is one that can be bent, rolled or folded to a certain degree, where the stresses applied to the material due to such bending, rolling or folding forces is less than the yield strength of the material. A stretchable material is one that can be stretched or strained elastically to a certain degree while not becoming permanently deformed to a significant extent upon release of such stresses applied to the material.

Many conventional flexible film-based electrodes, such as some of the types described above, are flexible but not stretchable. In contrast, the metal impregnated elastomeric material formed in accordance with the invention is both flexible and stretchable so as to render such material very useful for forming compliant electrodes or other components requiring such flexible and stretchable properties.

The term "impregnated", as used herein with reference to metal salt impregnated materials, refers to the metal salt being embedded within but not covalently bonded with an elastomer precursor material as a result of being mixed within the polymer material in accordance with methods of the invention. In addition, the term "impregnated", as used herein with reference to metal impregnated elastomer materials, refers to the metal being coated onto and/or embedded within an elastomer material as a result of an impregnated metal salt being chemically reduced in accordance with methods of the invention. As described below, some of the metal is disposed at an outer surface of the metal impregnated elastomer material, while some of the metal remains impregnated or embedded within the material. As further described below, a concentration or density gradient of metal forms from the material surface to a selected depth within the resultant material, with the highest concentration or density of metal being at the surface of the material and the density of metal decreasing from the material surface to the selected depth within the material. In particular, a first concentration of metal at a surface of the material is greater than a second concentration of metal at a central interior section of the material. The density of metal in other cross-sectional locations of the resultant material can be generally uniform or, alternatively, can vary.

Utilizing the methods described below for forming the metal impregnated elastomeric materials of the invention, the materials can be stretched up to about 40% in length from a relaxed state (i.e., prior to elongation) while maintaining conductivity higher than $10^{-5}$ S/cm. The elastomeric materials are further suitably resilient such that they relax to approximately their original (i.e., unstrained) states after removal of such strains. The metal impregnated elastomers of the invention have an elastic modulus (Young's modulus) of no greater than about 100 MPa, preferably no greater than about 50 MPa, and most preferably no greater than about 20 MPa. Further, the metal impregnated elastomers of the invention are capable of maintaining electrical conductivity levels of at least about $10^{-10}$ S/cm when being subjected to strains of at least about 1% (i.e., a stretch or elongation of at least about 1% in length from a relaxed position), and are further capable of maintaining electrical conductivity levels of at least about $10^{-6}$ S/cm when being subjected to strains of at least about 5%.

Exemplary products or devices that can be formed with the electrically conductive metal impregnated elastomers of the present invention include, without limitation, compliant electrodes (e.g., for use with dielectric elastomer actuators), strain gauges, electrically conductive textiles (e.g., by incorporating the electrically conductive elastomer into fabrics and clothing to provide electrical components in the clothing such as personal digital assistants, haptic display devices, sensor devices, devices for biomedical applications such as electrodes for electrocardiogram and/or electroencephalogram devices), compliant electrical cables (e.g., for connecting two or more electronic components or devices that are movable with respect to each other), and electromagnetic shielding and/or electrostatic discharge protection materials for electronic components or devices. The metal impregnated elastomer materials can further be formed utilizing any one or combination of techniques including, without limitation, etching, stenciling, stamping, molding, photomasking, and printing, and the materials can be shaped into any selected number of dimensions (e.g., two or three dimensional shapes) to form products of varying sizes, patterns and geometries.

In one embodiment of the invention as described below, the metal impregnated elastomers are formed by the addition of a metal salt into an elastomeric precursor matrix, followed by crosslinking or curing of the precursor matrix and then chemically reducing the metal salt to form the conductive metal within the cured elastomer. In another embodiment of the invention as described below, the elastomer is swelled in a suitable solvent during the chemical reduction of the metal salt within the elastomer. The swelling of the elastomer during the chemical reduction step in accordance with the invention further enhances the electrical and mechanical properties of the resultant metal impregnated elastomer material.

The electrically conductive elastomers can be fabricated with a wide variety of polymers, including polymers that are compatible with microfabrication techniques. In addition, the electrically conductive elastomeric materials can be patterned using ultraviolet (UV) light shone through a mask. In addition, they can be patterned using other microfabrication techniques including, without limitation, photolithography, wet chemical etching, and dry etching, etc. Further, the electrically conductive elastomers can be formed and shaped into a variety of different geometries using methods such as casting, molding, and printing.

Elastomers having sufficient elasticity for use with forming compliant electrodes and other components in accordance with the invention can be natural or synthetic rubber materials including, without limitation, any one or combination of linear polymers, branched polymers, star polymers, comb polymers, linear copolymers, block copolymers, grafted polymers, random copolymers, alternating copolymers, and crosslinkers. Exemplary elastomers include, without limitation, natural rubbers, polyisoprenes (e.g., copolymers of isobutylene and isoprene), polybutadienes (e.g., styrene butadiene copolymers), copolymers of polyethylene and polypropylene (e.g., ethylene propylene diene rubber or EPDM), polyacrylates (e.g., acrylate butadiene rubber or ABR), polyurethanes, polysulfides and silicon based materials such as silicones (e.g., polydimethylsiloxane or PDMS).

The electrically conductive elastomeric materials of the invention are formed with suitable elastomer precursors that can be crosslinked or cured via any suitable process or technique. Exemplary crosslinking techniques that are suitable for the invention include, without limitation, exposure of the elastomer precursor to a source of energy such as heat or electromagnetic radiation such as ultraviolet (UV) light, any suitable polymerization technique (e.g., step, chain or condensation polymerization) and/or the addition of a suitable chemical crosslinking agent to the precursor. Preferably, the elastomer precursor has a suitable viscosity, or can be dissolved in a suitable solvent to obtain a suitable viscosity, that is sufficiently low (e.g., no greater than about 70,000 centipoise) to facilitate adequate mixing of the metal salt with the precursor during formation of the electrically conductive elastomer.

The elastomer precursors can include any one or combination of suitable monomers, dimers, trimers, oligomers, polymers, sulfur groups, and crosslinking moieties that can be crosslinked to form any of the elastomers noted above. Exemplary elastomer precursors used to form the conductive elastomer materials of the invention include, without limitation, ethylene propylene materials, polybutadiene materials, latex materials such as isoprene, UV-curing and/or acrylic elastomers such as the type commercially available under the tradenames LOCTITE 3108 (Henkel Corporation, Connecticut), silicone materials such as the types commercially available under the tradename SYLGARD 184 and SYLGARD 186 (Dow Corning Corporation, Michigan), polyurethanes and fluoroelastomers.

Suitable metal salts for impregnating the elastomeric materials are preferably soluble in the elastomeric precursor during formation of the elastomer and are reducible to metals when exposed to one or more suitable chemical reducing agents. The metal salts can include any metals that are suitably conductive and/or have suitable magnetic properties including, without limitation, salts of platinum, silver, palladium, gold, copper and iron. Exemplary metal salts that can be used in forming the conductive metal impregnated elastomers of the invention include, without limitation, tetraammineplatinum(II) chloride ($Pt(NH_3)_4Cl_2$), tetraammineplatinum(II) nitrate ($Pt(NH_3)_4(NO_3)_2$), tetraammineplatinum(II) hydroxide ($Pt(NH_3)_4(OH)_2$), dichlorophenanthrolinegold (III) chloride ($[Au(phen)Cl_2]Cl$), bis(ethylenediamine)gold (III) chloride ($[Au(en)_2]Cl_3$), tetraamminepalladium(II) chloride ($Pd(NH_3)_4Cl_2$), tetraamminepalladium(II) nitrate ($Pd(NH_3)_4(NO_3)_2$), silver nitrate and copper sulfate.

The elastomer precursor is mixed with the metal salt so as to sufficiently disperse the salt in the precursor material. Any suitable mixing techniques can be implemented to mix the metal salt with the elastomer precursor including, without limitation, mixing by hand, using a homogenizer, and using a mechanical stirrer. In certain applications, the metal salt can be mixed directly into the elastomer precursor. However, for other applications, better results are achieved by first dissolving the salt in a suitable solvent (e.g., water or organic solvents) and then mixing the metal salt solution with the elastomer precursor. This procedure can be useful even when the solvent has only a small miscibility with the precursor. In such mixing techniques using a solvent, any excess solvent that separates from the polymer mixture can be subsequently removed from the mixture. Any other suitable dispersal agent or compound that facilitates or enhances mixing of the metal salt with the precursor may also be used in the mixing process.

Once mixing is complete, the polymer/metal salt mixture can be formed into a film or any other form factor for a particular application. In the formation of a film, the polymer/metal salt mixture is applied to a substrate (e.g., via spin-coating, squeezing between two substrates, squeegee-coating, casting, etc.). After forming the film, the polymer/salt mixture is cured to form the elastomer with metal salt impregnated therein. For example, when using a UV-curing elastomer such as LOCTITE 3108, the polymer/salt mixture is exposed to UV light to cure the material and form the elastomer. This is possible because the salt does not absorb or scatter light to a significant extent. When using a silicone material (e.g., Sylgard 184) or other elastomer precursor that is cured with a chemical additive, a hardening or curing agent is added to the mixture to initiate a polymerization reaction which forms the elastomer.

Upon curing, the mixture forms as a solid elastomer composite material. However, the elastomer material is not conductive until the metal salt is converted to metal within the composite. This is accomplished by exposing the composite to an appropriate reducing agent to reduce the metal salt to a metal. Selection of a suitable reducing agent will depend on the particular salt used. For example, tetraammineplatinum (II)chloride can be reduced in an aqueous solution of sodium borohydride ($NaBH_4$) or lithium borohydride ($LiBH_4$). Immersion of the elastomeric composite in the reducing solution causes reduction of the metal-containing salt into a metal. The metal dispersed on the surface of and within the elastomeric matrix renders the composite electrically conductive without significantly decreasing the elastomeric characteristics of the polymer in which it is embedded.

Metal impregnated elastomers formed in the manner described above are very useful in forming compliant electrodes and electrical components, since these materials can withstand high strain without mechanical failure while maintaining suitable electrical conductivity. It is noted that the conductivity of the elastomer formed increases when the concentration of metal within the elastomer increases. This can occur by increasing the salt concentration in the precursor and/or increasing the amount of salt that is reduced to metal within the elastomer (e.g., by increasing the exposure time and/or amount of chemical reducing agent to which the metal salt/elastomer material is exposed). However, increasing the salt concentration and/or the amount of metal salt that is reduced to metal in the elastomer composite above a selected amount can have the effect of decreasing the maximum allowable strain at which the metal impregnated elastomer material can be subjected to while maintaining a desired level of electrical conductivity. Preferably, the metal salt is added to the precursor in a suitable amount to ensure that the percolation threshold is achieved in the metal impregnated elastomer that is formed. For example, using the salt tetraammineplatinum (II)chloride, an amount of at least about 8% by volume of the polymer/metal salt mixture ensures that the percolation threshold is achieved in the metal impregnated elastomer that is formed. In addition, it is noted that metal salt concentrations between about 8% and about 12% by volume, and even greater (e.g., as much as 15% by volume or more), of the polymer/metal salt mixture will yield impregnated metal elastomer composite materials having desirable electrical properties for particular applications. It is noted, however, that certain applications, such as electrostatic shielding, do not require high conductivity, and thus do not require the percolation threshold to be achieved within the materials. For example, in such applications as electrostatic shielding, the metal salt concentrations can be as low as about 5% by volume or less.

The following examples describe some exemplary methods for forming electrically conductive metal impregnated elastomer materials in accordance with the invention.

EXAMPLE 1

A platinum/LOCTITE 3108 elastomer composite is formed by first adding 0.85 g of tetraammineplatinum(II) chloride (Sigma-Aldrich) to 2.5 g of the precursor LOCTITE 3108 (Loctite Corporation). The elastomer and salt solution are then subjected to mixing (e.g., using an Ultra Turrax T18 homogenizer).

The platinum salt/precursor mixture is placed in a vacuum chamber for a sufficient period of time (e.g., from about 2 hours to about 24 hours, depending upon the vacuum applied within the chamber) to evacuate air bubbles and residual water from the mixture.

The mixture is then cross-linked to form a solid elastomer. The mixture can first be applied to a substrate. For example, a thin layer of a non-adhesive such as SYLGARD 184 elastomer base can first be applied onto two 3"×2" glass substrates or slides. The elastomer base facilitates easy removal of the composite from the glass slides following polymerization. Next, a small (e.g., dime-sized) portion of the platinum salt/precursor mixture is applied onto one of the glass slides. The mixture is flattened by pressing down with the second glass slide so as to sandwich the mixture between the elastomer base layers. A metal impregnated elastomer film can be formed of any selected thickness utilizing this method, particularly when spacers are used between the glass slides.

The platinum salt/precursor mixture is exposed to UV light at a suitable intensity and for a suitable time period to sufficiently cure the precursor. The intensity and/or time at which the platinum/precursor is exposed to UV light to sufficiently cure the precursor will depend upon the size and/or film thickness being treated. In the present example, a hand-held UV lamp (Spectroline, EN-180, center wavelength 365 nm) can be used that delivers a power flux of 5 $mW/cm^2$.

After curing of the elastomer precursor, the substrates can be separated from the material. The use of a non-adhesive layer facilitates easy separation of the elastomer from the slides or substrates. If no non-adhesive layer is used, immersion in an appropriate swelling solvent for approximately 5 minutes can separate the two substrates. A sample procedure involves immersion of the system in isopropyl alcohol for about 2-20 minutes. However, in certain applications it may be desirable to maintain permanent adhesion of the cured material on the substrate.

The metal salt impregnated in the polymerized elastomer is then reduced by immersing the elastomer in 500 mg sodium borohydride dissolved in 450 mL of deionized water at 60° C. for about 5 hours. After this time period has elapsed, the material is immersed into a fresh sodium borohydride solution (alternatively, another 500 mg of sodium borohydride can be added to the reduction solution) and the material is kept immersed in solution for an additional 5 hours. The resulting composite is an electrically conductive elastomeric film that can achieve strains of about 30% elongation while maintaining electrical conductivity (e.g., a conductivity above $10^{-5}$ S/cm).

The film becomes measurably conductive after as little as 10 minutes of immersion in the chemical reduction solution. The film can be reduced in one step or in numerous steps.

EXAMPLE 2

The electrically conductive platinum impregnated LOCTITE 3108 composite of Example 1 is electroplated with a layer of gold so as to provide an improved interconnection between the platinum metal particles. In particular, an electroplating solution is provided which is composed of 10 parts v/v of 1.7 M sodium sulfite and 1 part v/v Oromerse SO Part B (commercially available from Technic, Inc.). A reference electrode of silver/silver chloride and a counter electrode consisting of a gold-covered wafer can be used. The composite is placed in the electroplating solution with an applied voltage of −0.9 Volts, and the duration of electroplating is about 4000 seconds. The electroplating results in a thin layer of gold plated on the composite.

The thin layer of gold deposited on the platinum/LOCTITE 3108 composite provides an increased electrical conductivity for the material, since the gold enhances the electrical interconnections between platinum particles within the elastomer material. However, due to the stiffness of gold in relation to the elastomer material, the elasticity of the material decreases.

EXAMPLE 3

A mixed solution of tetraammineplatinum(II)chloride and LOCTITE 3108 is prepared in the same manner as described above in Example 1. The mixture is then applied to a substrate in the manner described below.

A layer of a transparent polyolefin wrap (e.g., a wrap that is commercially available under the trade name SealView from Norton Performance Plastics Corp.) is applied to the surface of a 3" by 2" glass slide, where the wrap is applied to minimize any air bubbles on the surface of the slide (so as to ensure a generally even surface for the composite film formed). The polyolefin wrap layer acts as a non-adhesive between the glass substrate and the polymer/platinum salt mixture.

A thin non-adhesive layer of SYLGARD 184 on the side of a transparency mask that will be contacted with the polymer/platinum salt mixture. LOCTITE 3108 is a negative resist, so the transparent portions of the mask will define the pattern of the LOCTITE 3108 composite film.

The platinum salt/precursor composite liquid mixture is squeezed between the transparency mask and the glass slide substrate to evenly disperse the mixture onto the substrate. Spacers can be used in between the mask and the substrate to define a film of a desired thickness.

The polymer/platinum salt mixture is crosslinked by exposing the mixture to UV light through the transparency mask so as to form a patterned film. For example, a film of approximately 200 μm thickness can be exposed for about 32 seconds using a hand-held lamp such as the type described in Example 1.

The polymer/salt patterned film is rinsed for about 15 seconds with acetone, and then immersed in a mixture of 500 mg of sodium borohydride and 125 mL of de-ionized water for about 1.5 hrs. Thus, a free-standing electrically conductive and patterned elastomeric film is formed. If it is desired that the film remain on the glass substrate, the polyolefin wrap is not used.

EXAMPLE 4

A platinum/polydimethylsiloxane elastomer composite is formed in the following manner. Ten mL of SYLGARD 184 silicone elastomer base is mixed with 1 mL of SYLGARD 184 silicone elastomer curing or hardening agent that facilitates crosslinking of the elastomer base. The elastomer base is mixed with the curing agent (e.g., by hand using a stirring rod) for a suitable time period (e.g., about 10 minutes). It is noted that, since SYLGARD 184 takes several hours to completely cure, the step of adding the curing agent before adding the platinum salt can be carried out without the mixture becoming too viscous for homogenization, provided the salt is added within a reasonable time period thereafter. The elastomer base/curing agent mixture is then placed in a vacuum chamber at a pressure of about 100 mTorr for about 20 minutes to remove air bubbles due to the agitation of mixing.

An amount of 3.145 g of the elastomer base/curing agent mixture is combined with 0.300 g of tetraammineplatinum (II)chloride in a small container. The platinum salt is mixed into the elastomer base/curing agent mixture (e.g., by hand using a stirring rod) for a suitable time period (e.g., about 10 minutes). The elastomer/platinum salt mixture is then placed in a vacuum chamber at a pressure of about 100 mTorr for about 20 minutes.

The elastomer/platinum salt mixture is then placed on a plastic substrate so as to allow the elastomer to further cure at a temperature between about 25-200° C. and for a time period that is sufficient for the temperature selected. For example, the composite mixture can be cured for 2 days at 25° C.

Upon curing of the elastomer composite to form polydimethylsiloxane (PDMS), the platinum salt/PDMS composite is then immersed in 500 mg of sodium borohydride and 200 mL of de-ionized water for about 16 hours to sufficiently reduce platinum salt impregnated in the PDMS film to platinum metal. The resultant elastomer composite maintains desirable electrical conductivity while being stretched at varying lengths.

Figure 2:
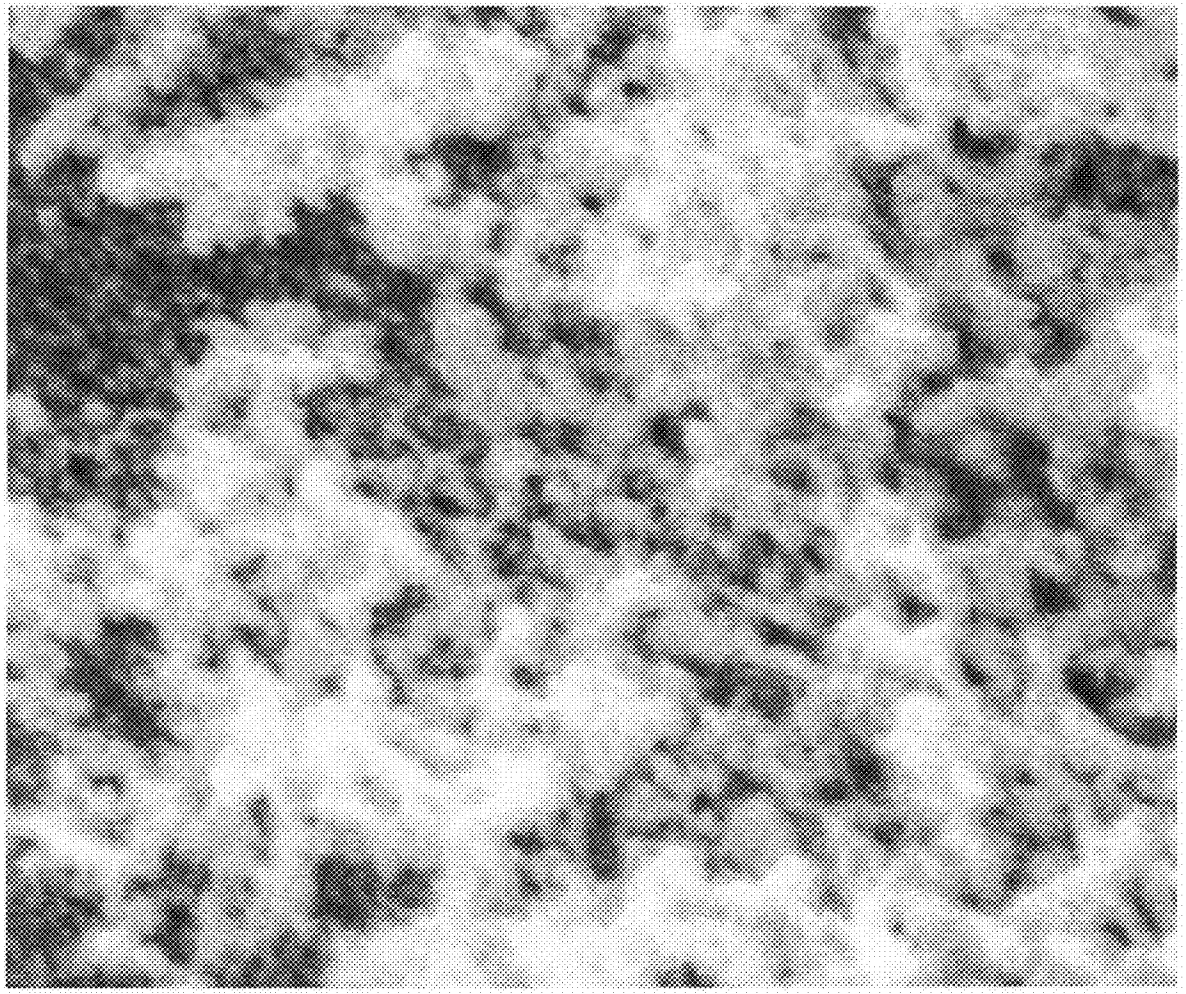
FIG. 2 is a SEM photograph of the top surface of a platinum/LOCTITE 3108 elastomer composite film formed in accordance with the invention with a platinum salt concentration of 10% by volume of the salt/precursor mixture.

As noted above, an increase in metal salt concentration in the elastomer precursor results in a greater conductivity for the resultant elastomer composite. This is illustrated in the plot of platinum salt concentration vs. conductivity depicted in FIG. 1, in which platinum/LOCTITE 3108 composite films were formed using varying platinum salt concentrations utilizing a method as described in Example 1. As can be seen in FIG. 1, the conductivity of the elastomer composite increases significantly at a platinum salt concentration of about 8% by volume of the salt/precursor mixture. The reason for this can also be seen in FIG. 2, which shows the scanning electron microscope (SEM) photograph of a platinum/LOCTITE 3108 composite material formed using the method of Example 1 with a platinum salt concentration of 10% by volume of the salt/precursor mixture. In particular, the SEM photograph shows platinum nodules covering the surface of the film that are approximately 100 nm in diameter. The material becomes conductive when the nodules have a sufficiently high area density to form interconnected conducting pathways.

Figure 3:
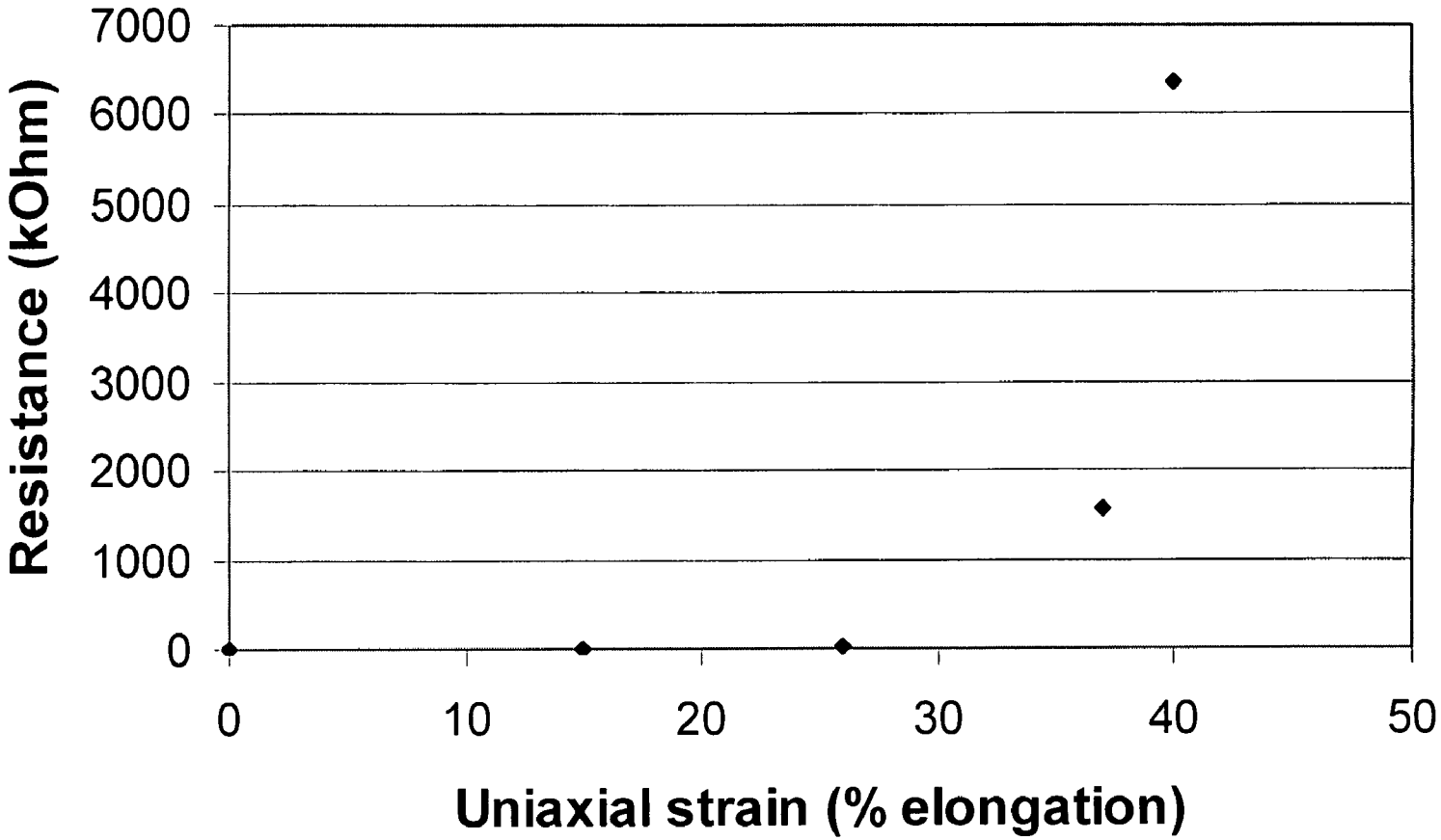
FIG. 3 is a plot of uniaxial strain vs. resistance of a platinum/LOCTITE 3108 elastomer composite film formed in accordance with the invention with a platinum salt concentration of 12% by volume of the salt/precursor mixture.

Platinum salt concentrations from at least about 5% to about 15% or greater by volume of the salt/precursor mixture yielded metal impregnated elastomer composite materials with suitable mechanical and electrical properties. FIG. 3 depicts a plot of measured resistance vs. uniaxial strain (where strain is the change in length over the original length, i.e., $\Delta L/L$; and uniaxial strain is a strain in only one dimension) applied to a platinum/LOCTITE 3108 composite film material formed utilizing the method described in Example 1 with the addition of platinum salt in an amount of 12% by volume of the salt/precursor mixture. As can be seen from the figure, the composite material exhibited suitable electrical properties (low resistance) under uniaxial strains approaching 40%. It is noted that a metal deposited layer (e.g., a gold layer electroplated to a platinum/LOCTITE 3108 composite film as formed in Example 2) on the metal impregnated elastomer can increase conductivity, since the metal layer provides an enhanced interconnection between the metal particles, although this reduces the elasticity.

The methods of forming metal impregnated elastomers as described above can be modified to enhance the mechanical and electrical properties of the formed elastomers in accordance with the invention. In particular, the modification involves swelling of the metal salt impregnated elastomeric matrix during chemical reduction of the metal salt to metal. The swelling of the elastomer can be achieved by adding a suitable solvent that induces swelling of the elastomer to the aqueous reducing solution. The swelling of the polymer matrix facilitates the reduction reaction by allowing easier access of the reducing agent to the salt (by facilitating movement of both the reducing agent and the salt within the elastomer). In addition, the increased volume of the polymer due to swelling during the formation of the metal is lost once the material is removed from the reducing solution, thus leading to a wrinkling of the metal layer, which is analogous to the stretching used to form corrugated metal films as described above. Swelling the elastomer during the chemical reduction step has the effect of increasing electrical conductivity of the metal impregnated elastomer composite by as much as 90 times and the maximum allowable uniaxial elongation (i.e., elongation prior to electrical failure of the composite) by as much as four times in comparison to non-swelled composites.

Any suitable solvent can be used that facilitates swelling of the metal salt/elastomer matrix during chemical reduction of the salt. Preferably, the solvent is miscible with water and does not degrade the polymer material. The solvent must also be capable of swelling the elastomer to a sufficient degree that is greater than the extent to which the elastomer swells in water alone. For example, it has been found that suitable solvents for swelling a UV-curable elastomer such as LOCTITE 3108 include, without limitation, acetone, ethanol, ethyl acetate, isopropanol, methanol, toluene, and xylene. Other examples of swelling solvents include chloroform, diethyl ether, alkanes such as heptane and hexane, and methylene chloride. The following table provides a list of swelling solvents that are useful for swelling a LOCTITE 3108 elastomer material and to what extent these solvents swell the material (as measured by change in weight).

TABLE 1

Weight increase after immersion of LOCTITE 3108 in Solvent

| Solvent | Steady-State Swelling after 30 Days (Weight Change %) |
|---|---|
| Acetone | 101 |
| Chloroform | 460 |
| Diethyl ether | 25 |
| Ethanol | 68 |
| Ethyl acetate | 122 |
| Heptane | 4 |
| Hexane | 3 |
| Isopropanol | 48 |
| Methanol | 55 |
| Methylene chloride | 429 |
| Toluene | 123 |
| Water | 14 |
| Xylene | 86 |

The following example provides an exemplary method of forming a metal impregnated elastomer composite material utilizing the elastomer swelling technique during chemical reduction in accordance with the invention.

EXAMPLE 5

A platinum/LOCTITE 3108 elastomer composite is formed in a similar manner as described above in Example 1, with the exception that the step of reducing the metal salt impregnated in the polymerized elastomer is performed by immersing the elastomer in a 30 mM solution of sodium borohydride in 50% by volume methanol and 50% by volume deionized water. The chemical reduction step is further performed in a single step of about 1 hour (in contrast to the longer two-step reduction process in the sodium borohydride/deionized water as described in Example 1).

The electrical conductivity was measured for platinum/LOCTITE 3108 composite materials formed using the two methods of Example 1 and Example 5 (the "swelling" method). Sample materials were formed for both examples using a range of platinum salt concentrations during the formation process. The electrical conductivity of each sample was measured using a two-point probe technique, with the probes being placed on the surface of the samples.

The electrical conductivity measurements showed as much as a 90-fold increase in electrical conductivity for composites formed with the swelling method of Example 5 in comparison to the method of Example 1. For example, for samples formed with 11% by volume platinum salt, the electrical conductivity for the sample formed using the swelling method of Example 5 was measured at about 6.36 S/cm, while the sample formed using the method of Example 1 was measured at about 0.07 S/cm.

Figure 4:
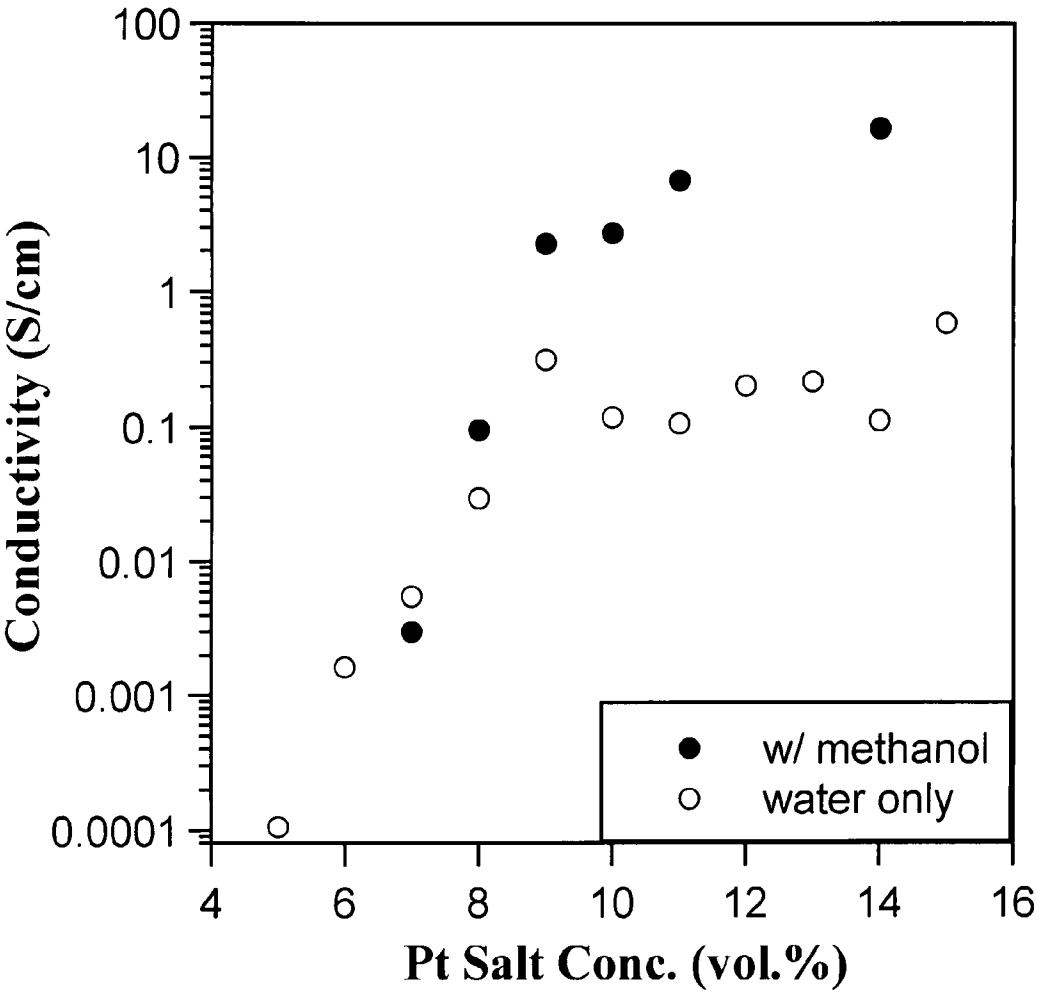
FIG. 4 is a plot of platinum salt concentration vs. electrical conductivity for platinum/LOCTITE 3108 composite materials formed utilizing different methods in accordance with the invention.

A plot is depicted in FIG. 4 of electrical conductivities of platinum/LOCTITE 3108 composite materials formed with varying salt concentrations and utilizing the methods of Example 1 (water only) and Example 5 (methanol with water). As can be seen from the figure, the electrical conductivities of both sets of samples increase significantly at a platinum salt concentration of about 8% by volume of the salt/precursor mixture. It can further be seen that the electrical conductivity of materials formed using the elastomer swelling technique (methanol with water) increases to a greater extent in comparison to the electrical conductivities of materials formed with a reduction solution containing only the reducing agent and water (water only).

Figure 5A:
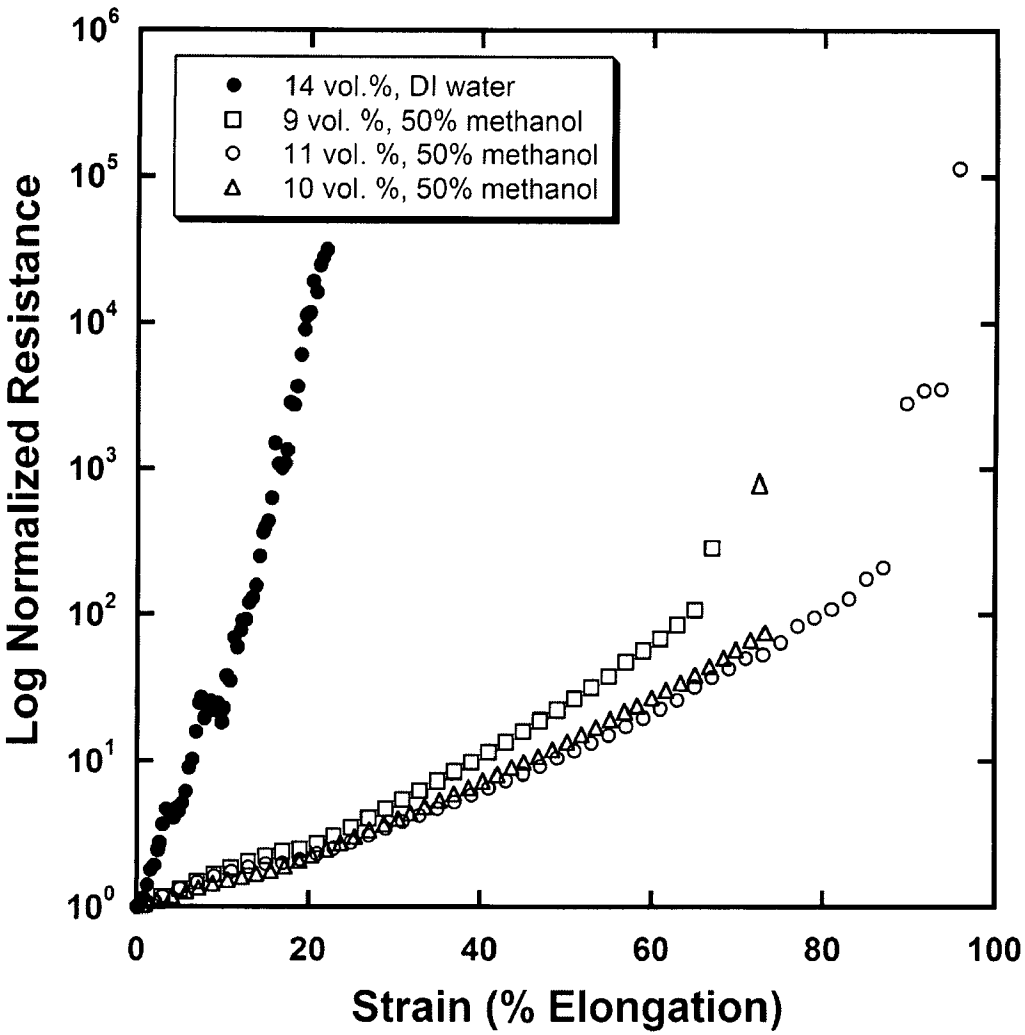
FIG. 5A is a plot of strain vs. resistance for platinum/LOCTITE 3108 composite materials formed with different platinum salt concentrations and utilizing different methods in accordance with the invention.

A plot of strain vs. resistance is depicted in FIG. 5A for a number of platinum/LOCTITE 3108 samples formed with varying platinum salt concentrations using the methods of Examples 1 and 5 (where "DI water" in the figure indicates a sample formed using the method of Example 1 and "50% methanol" in the figure indicates a sample formed using the method of Example 5). The plotted data indicate that a sample formed with a 14% by volume platinum salt concentration in deionized water only (i.e., using the method of Example 1) reaches a maximum uniaxial strain limit at which electrical failure or unacceptable electrical resistance occurs (which is not the same as mechanical failure) at about 25% (as can be seen from rapid increase in resistance values in the data plotted). It should be noted that the material recovers electrical conductivity when the strain is reduced below 25%, since the sample has not been damaged by such strains. Straining the material reduces the conductivity by increasing the separation between conductive regions (e.g. Pt-rich areas in the material, such as for example the Pt nodules seen on the surface), effectively bringing the material below the percolation threshold. Relaxing the strain brings the conductive regions back into contact.

In contrast, the resistance/strain curves of samples formed with 9%, 10% and 11% by volume platinum salt concentration in a 50/50 mix of methanol and deionized water (i.e., using the method of Example 5, where sufficient swelling of the elastomer is induced) are more flat, with respective maximum uniaxial strain limits being about 67%, 75%, and 98%. Thus, the data depicted in FIG. 5A indicate that the maximum uniaxial strain limits (i.e., where electrical failure or unacceptable electrical resistance occurs) for metal impregnated elastomers of the invention that have been subjected to sufficient swelling during chemical reduction of the metal salt are as much as four times greater in comparison to the maximum uniaxial strain limits of metal impregnated elastomers of the invention that have not been subjected to swelling.

In addition, it can be seen From FIG. 5A that the change in resistance is generally linear with strain at least up to point of the maximum uniaxial strain limit for the metal impregnated elastomers. This indicates that these materials are particularly useful for the formation of electrical devices such as strain gauges, where the level of strain can be measured based upon a measured change in electrical resistance. Further, the amount of platinum salt needed in the elastomer material to achieve significant strains diminishes when the swelling technique is employed, thus reducing the costs involved for production of the material.

Figure 5B:
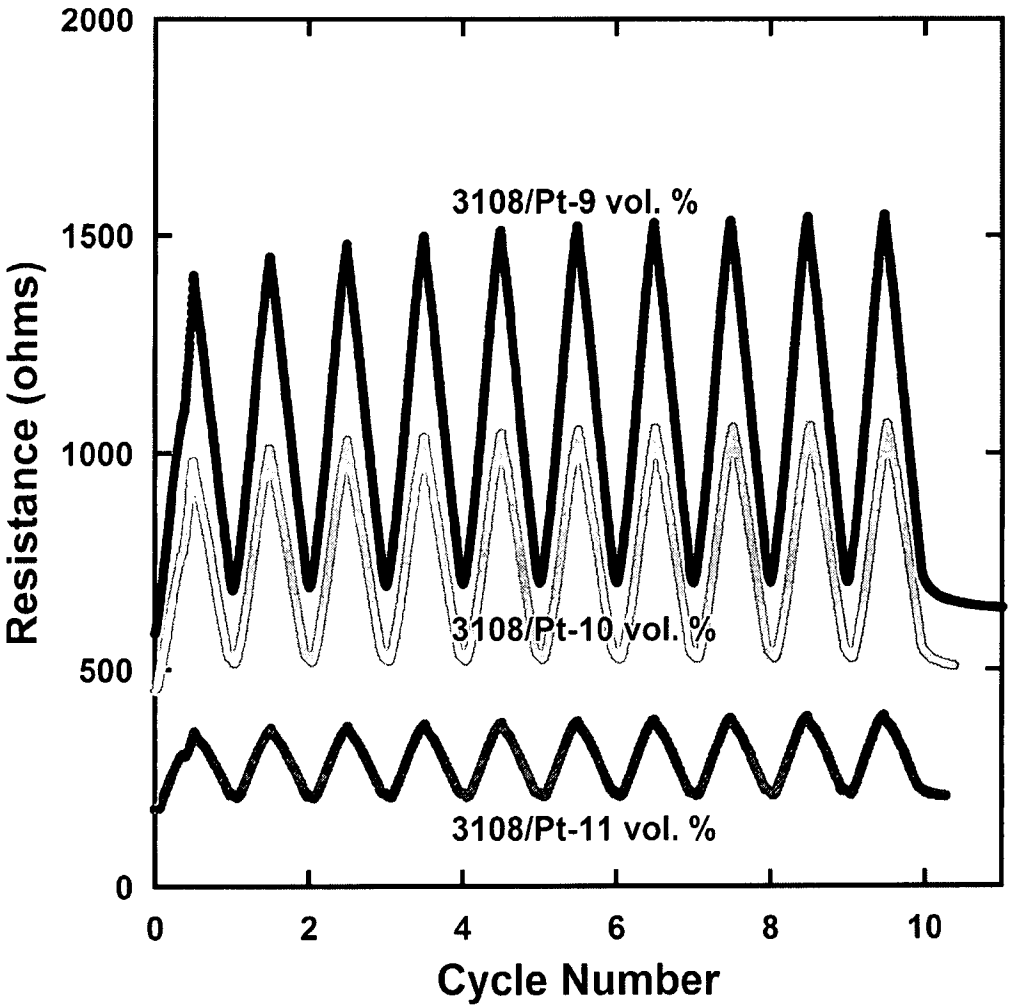
FIG. 5B is a plot of a series of cycles of strain vs. resistance (where the period of each cycle is over an elongation that extends from 0-20% and then from 20-0% elongation) for platinum/LOCTITE 3108 composite materials formed with different platinum salt concentrations in accordance with the invention.

Metal impregnated elastomer materials of the invention that have been subjected to swelling are capable of withstanding numerous strain/relaxation cycles while maintaining a repeatable response in change of electrical resistance over a strain cycle that is within or up to electrical failure. The plot in FIG. 5B shows compliant film electrodes formed with the swelling technique (i.e., the method of Example 5) that have been repeatedly subjected to a 0-20% uniaxial elongation, followed by relaxation (i.e., release of strain on electrodes), over a number of cycles. In particular, compliant film electrodes were tested with the following materials: platinum/LOCTITE 3108 composite material formed with 9% by volume platinum salt, platinum/LOCTITE 3108 composite material formed with 10% by volume platinum salt, and platinum/LOCTITE 3108 composite material formed with 11% by volume platinum salt. As can be seen in FIG. 5B, each electrode exhibited a repeatable response in resistance over a series of cycles, indicating that the electrodes provide a reliable electrical response over the elongation range which is essential for strain gauges and other types of sensors.

Figure 6A:
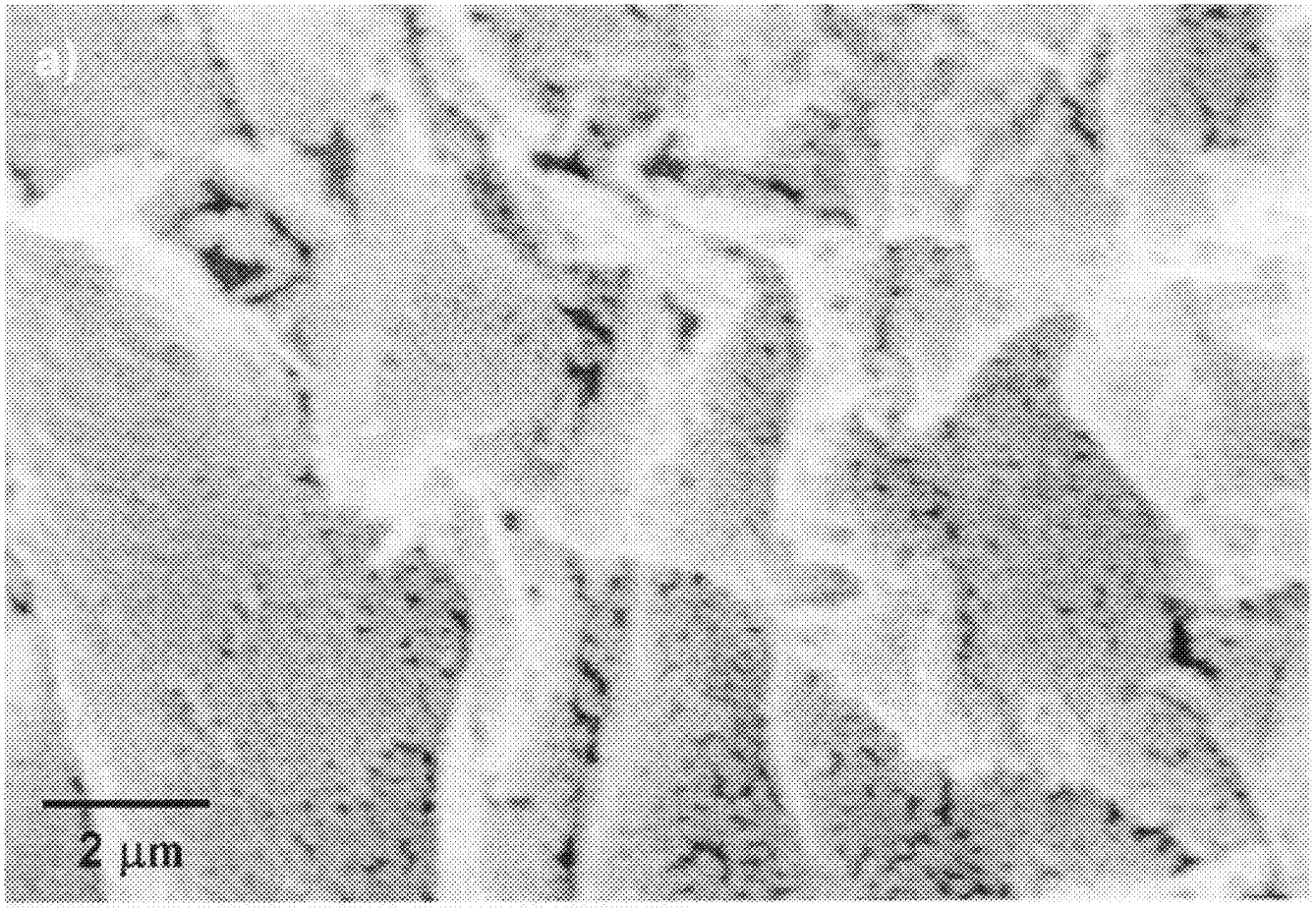
FIGS. 6A and 6B are SEM photographs of top surface views of platinum/LOCTITE 3108 composite materials formed in accordance with the invention.
Figure 6B:
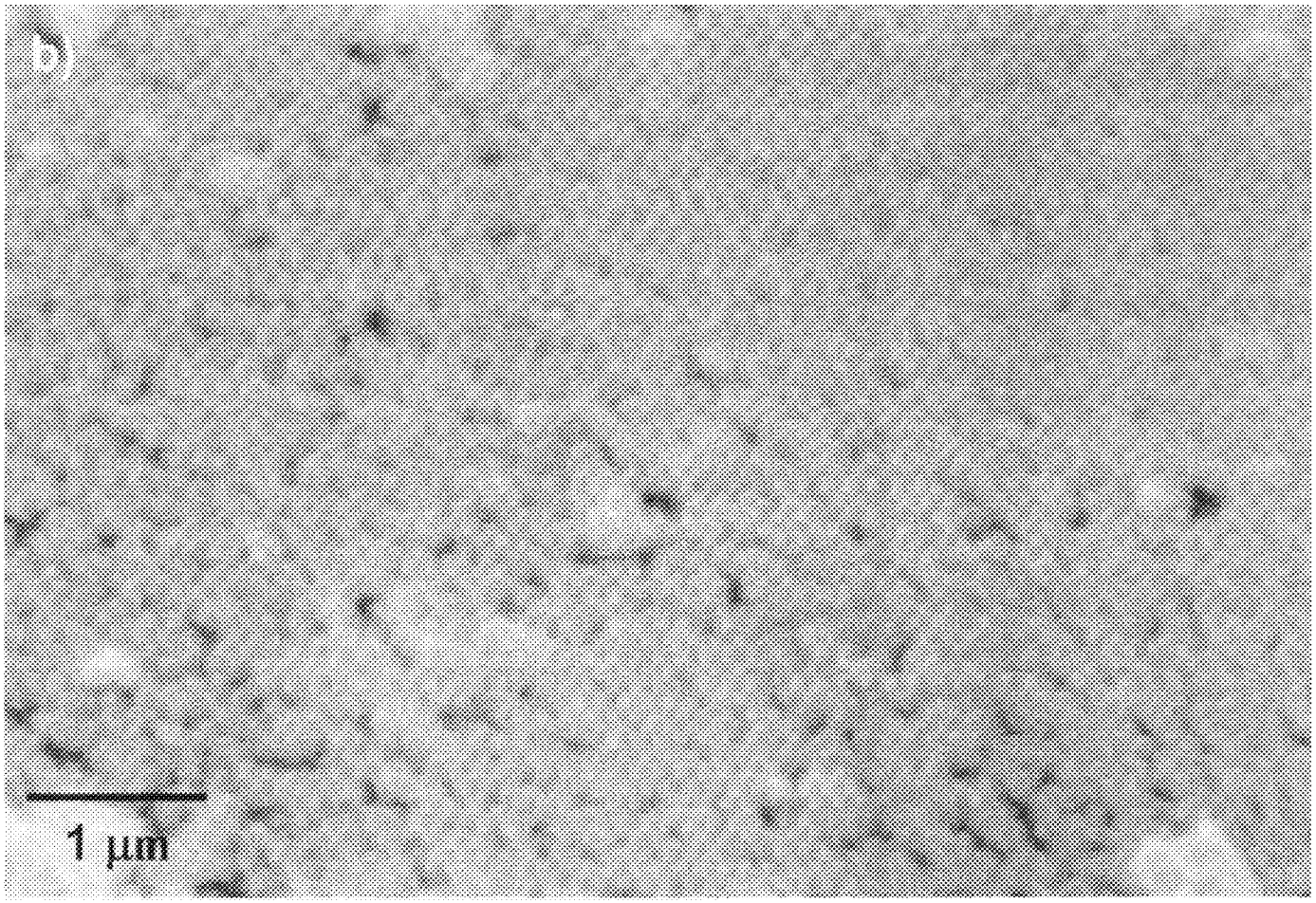
Figure 7A:
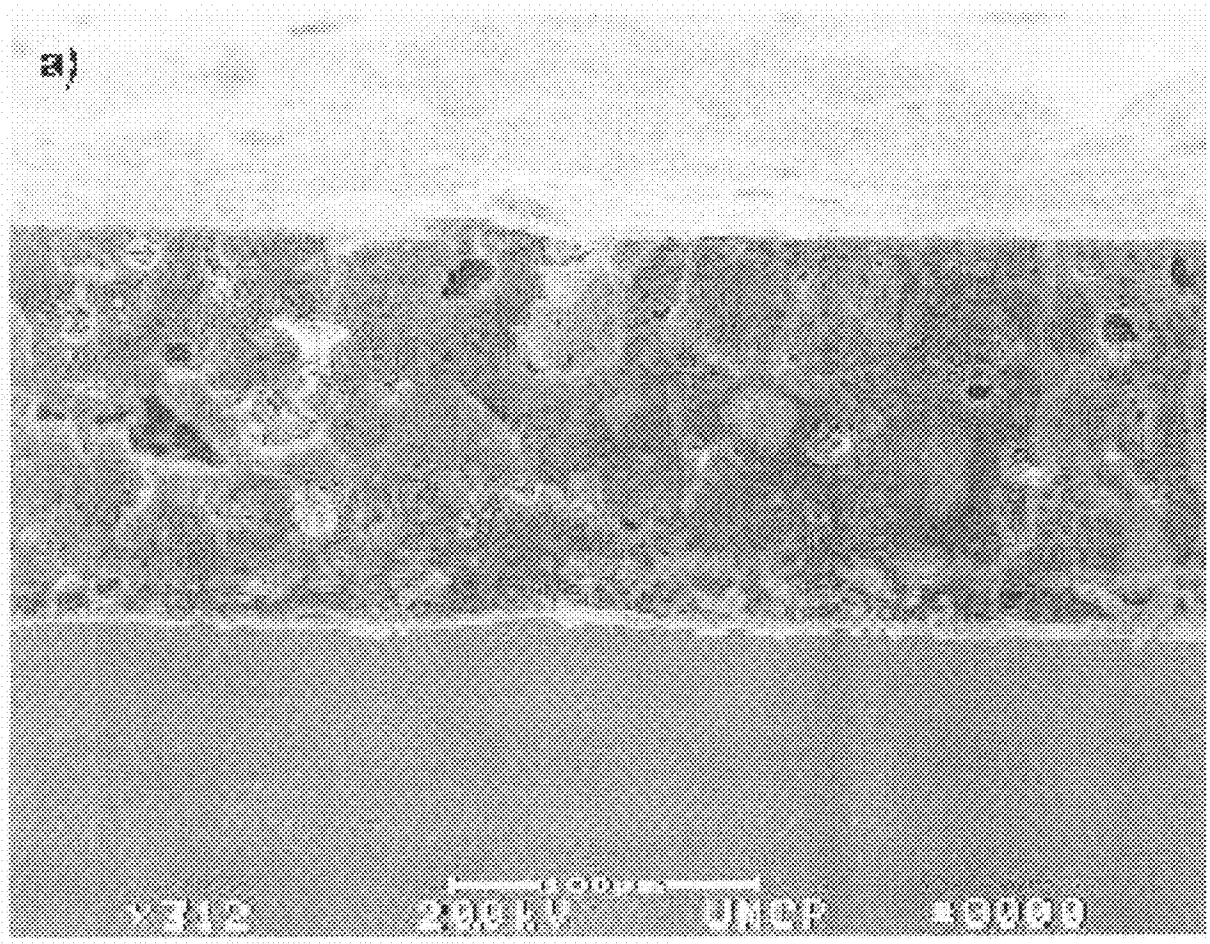
FIGS. 7A and 7B are SEM photographs of cross-sectional views of the platinum/LOCTITE 3108 composite materials of FIGS. 6A and 6B.
Figure 7B:
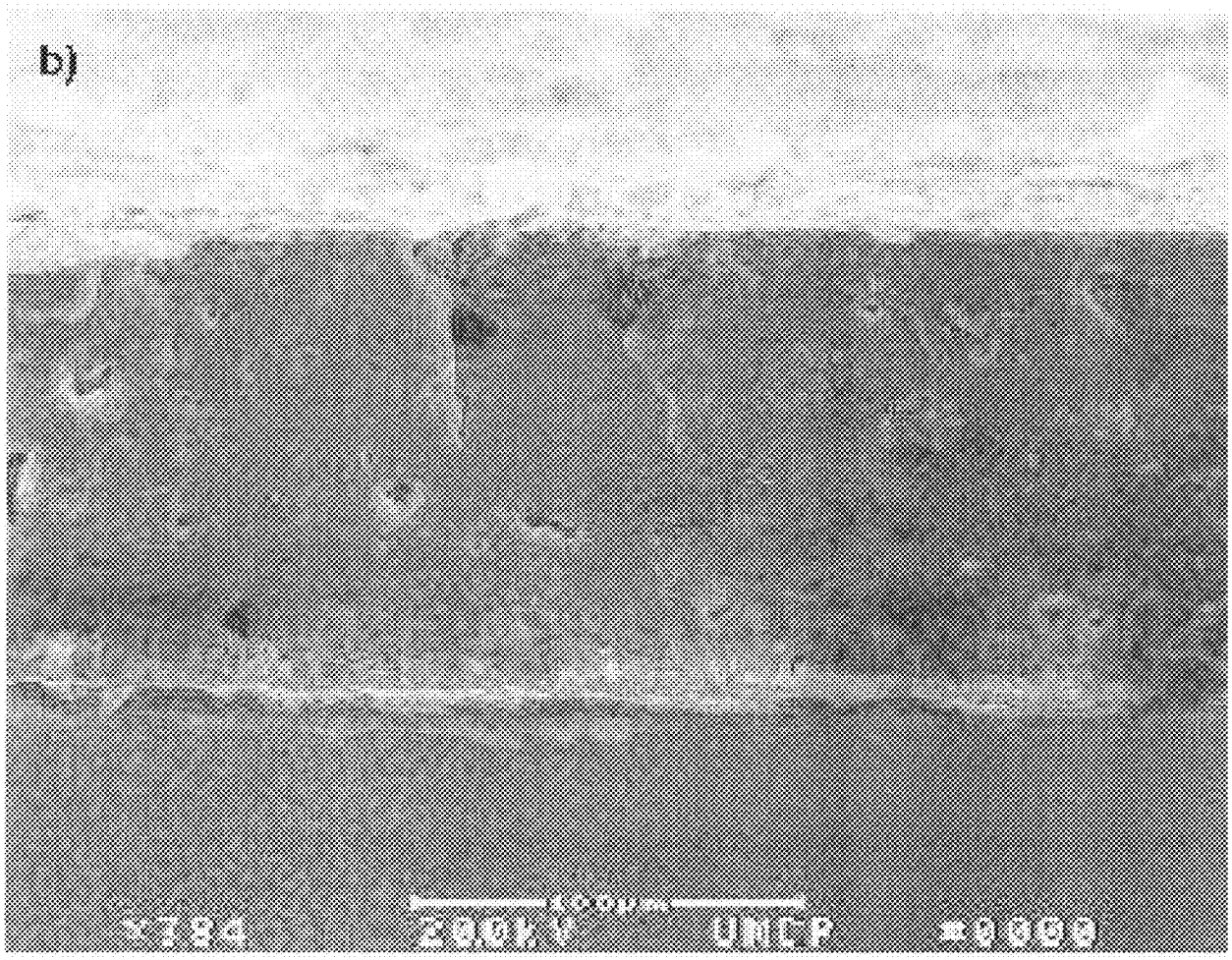

Differences between metal impregnated compliant materials formed with the swelling technique vs. other metal impregnated compliant materials formed in accordance with the invention can be seen in the SEM photographs depicted in FIGS. 6 and 7. In particular, two platinum/LOCTITE 3108 compliant electrodes formed with 12% by volume platinum salt according to the methods of Examples 1 and 5 are shown side-by-side in FIGS. 6 and 7, where FIGS. 6A and 6B depict a top view of the surface of the electrodes and FIGS. 7A and 7B depict a cross-section through each electrode. Referring to FIG. 6A, the top surface of the electrode formed using the swelling technique (e.g., according to Example 5) includes a slightly wrinkled platinum surface, whereas the top surface of the electrode formed according to Example 1, as shown in FIG. 6B, has a relatively smooth platinum surface. FIG. 7A depicts a cross-section through the electrode formed with the swelling technique, whereas FIG. 7B depicts a cross-section through the electrode formed by Example 1. In both of FIGS. 7A and 7B, a high concentration of platinum can be seen at the surface of the electrode, with a concentration decrease in platinum occurring with an increase in depth from the surface of the electrode.

The wrinkled platinum surface shown in FIG. 6A appears to be caused by the swelling of the elastomer that occurs during reduction of the platinum salt to metal, followed by shrinking of the elastomer back to its normal state which causes the formed platinum surface at the top of the material to wrinkle. The out-of-plane wrinkled platinum surface of this metal impregnated elastomer composite material straightens when the elastomer is strained without compromising the integrity of the metal interconnects, thus allowing the elastomer to undergo larger strains without reaching electrical failure. Upon removal of the strain from the elastomer, the platinum surface relaxes to its wrinkled state. Thus, the wrinkling of metal at the elastomer/metal surface due to the formation of the composite with the swelling technique at least partially accounts for the enhanced mechanical and electrical performance of the material.

It is further believed that a reason for why composite materials formed with the swelling technique of the invention have a higher electrical conductivity in a relaxed (i.e., unstretched) state in comparison to other composite materials of the invention formed using the same salt concentrations is that the swelling technique facilitates a deeper penetration of the reducing agent and/or greater migration of metal salts and/or metals within the swelled polymer during the chemical reduction process. Thus, it would appear that the swelling technique provides a higher concentration of metal impregnated within the elastomer composite material and/or an increase in the metal thickness at the surface of the material, which results in enhanced electrical conductivity of the material.

A concentration or density gradient of metal within the metal/elastomer composite materials of the invention was confirmed using energy dispersive X-ray spectroscopy (EDS) and SEM imaging. In particular, a platinum/LOCTITE 3108 composite material that was formed with 11% by volume platinum salt using the swelling technique (as set forth in Example 5) was analyzed with EDS at the surface and at varying depth locations within the material to determine to what extent a density gradient of platinum exists within the material. The EDS measurements indicated that the concentration of platinum at the surface of the material is 100% or nearly 100% (i.e., the surface is substantially entirely platinum). However, the concentration of platinum at a first location about 20-60 microns below the surface and at a second location about 50-90 microns below the surface was a detectable but much smaller amount.

Thus, the EDS measurements indicate that a concentration or density gradient of metal exists within the metal impregnated elastomer materials formed in accordance with the invention, where a significant drop in metal concentration occurs from the surface of the materials to a selected depth (e.g., no more than about 30 microns from the surface) within the materials. Further, the concentration of metal at a central location of the material is less than the metal concentration at the surface of the material. Further, the amount of embedded or impregnated metal throughout the cross-section of the materials appears to remain generally uniform after the rapid decrease in metal density within the selected depth from the material surface. However, it is noted that materials can also be formed in accordance with the invention in which the concentration or density of metal embedded or impregnated within the elastomer material differs at two or more cross-sectional locations at any portions of the material. The embedded or impregnated metal within the elastomer is further not chemically (e.g., covalently) bound to the polymer units within the material.

In the EDS measurements, there was no detection of residual compounds or elements from the platinum salt (e.g., chloride ions) or the reducing agent (sodium borohydride) along the cross-sections of the composite materials. This would appear to indicate that substantially no unreacted residual metal salts and reducing compounds remain in the resultant metal impregnated elastomer materials.

Having described exemplary embodiments for electrically conductive metal impregnated elastomers, compliant electrodes and other electrical components formed from such elastomers, and methods of forming electrically conductive metal impregnated elastomers, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed:

1. An electrically conductive and compliant material comprising:

a base structure comprising an elastomer; and a metal mixed within the elastomer base structure, wherein a concentration of metal at a surface of the base structure is greater than a concentration of metal at a selected depth from the surface of the base structure, and wherein the metal comprises a plurality of separate and individual metal nodules ananged so as to define a conductive pathway between metal nodules of the base structure;

wherein the material maintains a selected range of electrical conductivity when being stretched a selected amount from a relaxed position; wherein the material maintains an electrical conductivity of at least about $10^{-10}$ S/cm when being subjected to a strain of at least about 1%.

2. The material of claim 1, the material maintains an electrical conductivity of at least about $10^{-6}$ S/cm when being subjected to a strain of at least about 5%.

3. The material of claim 1, wherein the material has an elastic modulus no greater than about 100 MPa.

4. The material of claim 1, wherein the material has an elastic modulus no greater than about 20 MPa.

5. The material of claim 1, wherein the metal mixed within the elastomer base structure comprises at least one of platinum, silver, palladium, gold, copper, and iron.

6. The material of claim 1, wherein the elastomer comprises at least one of a polyisoprene, a polybutadiene, a copolymer of polyethylene and polypropylene, a polyacrylate, a polyurethane, and a silicon containing material.

7. The material of claim 1, further comprising a metal coating deposited on the surface of the base structure.

8. The material of claim 1, wherein the surface of the material is wrinkled.

9. The material of claim 1, wherein the electrical conductivity of the material changes with the amount of strain applied to the material.

10. The material of claim 1, wherein the elastomer base structure has a patterned configuration having different dimensions.

11. The material of claim 1, wherein the surface of the base structure includes separate and individual metal nodules located along the surface of the base structure and arranged so as to define a conductive pathway along the surface of the base structure.

12. The material of claim 1, wherein the material maintains an electrical conductivity when being subjected to a strain of at least about 30% from a relaxed position.

13. The material of claim 1, wherein the elastomer base structure has a three-dimensional shape.

14. A compliant electrode comprising the material of claim 1.

15. A strain gauge comprising the material of claim 1.

* * * * *

UNITED STATES PATENT AND TRADEMARK OFFICE

CERTIFICATE OF CORRECTION

PATENT NO. : 7,695,647 B2
APPLICATION NO. : 11/946425
DATED : April 13, 2010
INVENTOR(S) : Smela et al.

It is certified that error appears in the above-identified patent and that said Letters Patent is hereby corrected as shown below:

Column 16, line 19, replace "metal nodules ananged" with -- metal nodules arranged --.

Signed and Sealed this

Twentieth Day of July, 2010

David J. Kappos

David J. Kappos
*Director of the United States Patent and Trademark Office*